US005419561A

United States Patent [19]

Weber

[11] Patent Number: 5,419,561

[45] Date of Patent: May 30, 1995

[54] METHOD OF PLAYING GOLF GAME ON REDUCED SIZE COURSE

[76] Inventor: Charles G. Weber, 10501 Red Maple Ave., Richmond, Va. 23233

[21] Appl. No.: 168,365

[22] Filed: Dec. 17, 1993

Related U.S. Application Data

[63] Continuation-in-part of Ser. No. 826,483, Jan. 24, 1992, abandoned.

[51] Int. Cl.[6] ..... A63B 67/02

[52] U.S. Cl. ..... 273/176 AB

[58] Field of Search ..... 273/176 R, 176 A, 176 AB, 273/176 E, 176 F, 176 FA, 176 FB, 176 G

[56] References Cited

U.S. PATENT DOCUMENTS 3,671,042 6/1972 Garber ..... 273/176 J X 5,203,566 4/1993 Ricigliano ..... 273/176 AB X

*Primary Examiner*—George J. Marlo

[57] ABSTRACT

A method of playing traditional, championship golf using only a putter and single golf ball, comprising the steps of a) providing a reduced size course on limited acreage including a series of holes requiring 72 strokes for par play, the said holes requiring par strokes respectively of four par-3 holes, four par-5 holes and ten par-4 holes.

b) providing representations of natural hazards along said holes as bunkers and water hazards by selectively colored areas wherein a selected color is employed to represent a particular hazard and any penalty associated therewith, and, c) providing and indicating maximum distance boundaries along said holes in selective manner past which the player must not stroke a ball with the putter without incurring a penalty, and, d) thereby permitting the player to play the reduced area course with only a putter as if it were a full size championship course by virtue of the selective stroke distance boundaries and hazard indications.

3 Claims, 9 Drawing Sheets

ALL PUTT 18-hole, par 72 golf course

ALL PUTT 18-hole, par 72 golf course

ALL PUTT GOLF COURSE / 1.5 ACRES
305' x 215' - 65,000 square feet

SIX SCORING VARIATIONS ON TYPICAL PAR 4 ALL PUTT HOLE

SIX SCORING VARIATIONS ON TYPICAL PAR 4 ALL PUTT HOLE

METHOD OF PLAYING GOLF GAME ON REDUCED SIZE COURSE

BACKGROUND/CROSS REFERENCE, RELATED APPLICATION

This application is a continuation-in-part of prior application Ser. No. 07/826,483, filed Jan. 24, 1992 for REDUCED-SIZE, ALL WEATHER GAME BASED ON TRADITIONAL GOLF, now abandoned.

BACKGROUND/FIELD OF THE INVENTION

My invention relates to golf. More specifically, it relates to full-size, championship golf played by professionals as a sport and by serious amateur golfers in tournament play. In particular, this new golf game uses modified, traditional rules to play a form of championship golf on a compact course with a putter and a single golf ball.

FIELD OF SEARCH

273/176, 273/176A, 273/176AB, 273/176B, 273/176D, 273/176E, 273/176F, 273/176LG, 273/176JX, 273/176J, 273/176BX, 273/176FB

REFERENCES CITED

| | | | |
|---|---|---|---|
| Valvano | 84,224/May 1931 | Gage | 2,482,210/May 1935 |
| Reilly | 3,083,021/Mar 1963 | Ward | 3,427,030/Feb 1969 |
| Purdy | 3,719,360/Mar 1973 | Healy | 4,145,053/Mar 1979 |
| Renn | 4,157,831/Jun 1979 | Beam | 4,225,136/Sep 1080 |
| Gallic | 4,294,450/Oct 1981 | Eady | 4,743,026/May 1988 |
| Grigas | 4,726,589/Feb 1988 | Mazer | 4,934,704/Jun 1990 |

BACKGROUND/HISTORY AND PRIOR ART

Millions watch TV tournament golf and have become sophisticated as to its rules and tradition. TV coverage of the PGA golf tour and major USGA amateur golf championship events has fueled their competitive spirit. Professional golf, an internationally played spectator sport, now has role models and stars like other major sports. Unlike baseball, basketball and football, golf is played by tens of millions of fans.

Expanded TV exposure has made golf the fastest growing participant sport in the world. Sports fans, players of other sports, and many who have never played any sport are caught up in the golf syndrome. They long to play the game competitively, like they see it played on television, but they can't. They are among a large group, perhaps millions of people, who can't afford to play golf at today's inflated prices or can't find golf courses available to them.

The costs of land, labor, golf course construction and maintenance have been increasing for several years now and new course development has decreased as a result. Investors are unable to make a profit. Other costs such as greens fees, playing equipment, and lessons have gone beyond most peoples budgets. It takes 4½ to 6 hrs to play 18 holes because of crowded facilities and that's too long. No credible alternative has been developed. For amusement, a few options exist like miniature golf, pitch and putt golf, executive golf, high-tech electronic golf and target golf.

What real golf enthusiasts want, however, is a game which will provide them with the same level of challenge as full-sizse golf while addressing all of the above problems. My invention offers answers to those problems. A documented market study which identified this golf game as ALL PUTT Championship Golf for the purpose of market identity, shows it has excellent commercial viability. A trademark design for ALL PUTT and US APGA are registered with the USPTO.

None of the following examples of reduced-size Golf qualify as an alternative to tournament level, full size championship golf. They are novel in their attempt to find a way but fail to meet the prerequisites. Many others fall into the same category.

PERRY/Method and golf course/#4,988,105/Jan. 29, 1991

A game played on 12 acres from a driving range type tee area with multiple balls hit to a variety of targets and a separate putting green having multiple cups. A novel concept but untraditional by design. Airborn shots and a full set of golf clubs are used.

GARBER/Golf course/#3,671,042/Jun. 20, 1972

A golf course of undetermined total holes and overall size played with a wedge and a putter. Artificial means of directing a golf ball from the teeing area include a curved and banked path and areas inclined toward the tee or depressions in the ground. Some areas may contain a variety of materials which purposely impede the ball's forward motion. Rather than allowing a player to use putting skill curved, banked pathways are provided to guide a golf ball to a predetermined area. Limited landing areas of landing zones identify more closely with hazards. Once a ball is stopped within one of these areas it must be lifted and played from a secondary tee because the nature of the area on which it rests will not allow a ball to be putted from it. The game may also be played using airborn shots made with a pitching wedge. It is a novel concept but untraditional in design. It could not qualify as a credible alternative to tournament level, full-size golf. The patent for this golf course has expired with no known history of commercial application.

RICIGLIANO/Simulated Golf Course/U.S. Pat. No. 5,203 566/Apr. 20, 1993

An indoor miniature golf game having a plurality of holes all of which are dogleg configurations, having intermediate target areas and hazards constructed of materials designed to impede the forward motion of a golf ball in varying degrees. Two kinds of golf balls are used on each hole. One ball travels only 25% as far as a regulation ball and is used from tee to green to propel it through the air. At the green it is replaced by a regulation ball which is then used for putting. This is a golf-like game and golf course, untraditional in design. It is not a credible alternative to full size, championship golf.

TRASKO/Golf Course and Method/U.S. Pat. No. 4,872,686/Oct. 10, 1989

A concept which requires untraditional methods such as teeing off for three holes in a grouping before doing any putting. The course is substantially rectangular rather than adaptable to all land configurations and terrain. All clubs are used, shots are airborn and playing surfaces are of natural grass. An 18-hole game is played on a minimum of 35 acres and does not qualify as a compact, cost saving alternative to full size golf.

ABERG/Scaled Down Golf Course Game/U.S. Pat. No. 4,413,827/Nov. 8, 1983

A golf game played with a full set of regulation golf clubs on a reduced version of a larger course. Two different golf balls are used. One ball travels only 25% as far as a regulation ball and is used from the tee and for approach shots to the green, all airborn. A regulation ball is used for chipping and putting when it has been advanced to inside a perimeter ring around the green. Playing surfaces are natural grass turf. The description refers to the course as a miniature golf course but it appears to occupy 35–45 acres. It is untraditional and does not contain the prerequisite, championship calibre features which would qualify it as a credible alternative.

BREWER/Golf Ball Putting Game/U.S. Pat. No. 3,885,795/May 27, 1975

Putting game playing course of miniature golf dimensions on which a putting game is played using a novel, egg shaped ball and putter. Because of contours and undulations in fairways, it appears that this is a game of chance rather than one of skill. Whichever, it is an interesting amusement facility but does not qualify as a tournament level game. It can not be considered a credible alternative to full-size championship golf.

OBJECTS AND ADVANTAGES

The primary object of my invention is to provide a marketable, credible alternative to full-size championship golf. Millions of golf enthusiasts who find competitive golf unavailable to them, and whose needs have not yet been met, provided the incentive to invent ALL PUTT Championship Golf. It is a novel method of playing traditional,full size championship golf to a compact-size alternative golf game without losing the challenge, excitement and inherent traditions of the full-size sport. Some objects and advantages of my invention are:

a) to provide an alternative golf game which costs less to play than full-size golf so that all who wish to play may do so. ALL PUTT Championship Golf costs under $10 dollars for 18-holes, there is no need to buy a set of 14 golf clubs, or a golf bag, golf balls or other golf supplies. No golf lessons are needed and there are no cart fees. A regulation putter and golf ball are all that is required. Advantages of my invention are obvious.

b) to provide an alternative to full-size, championship golf which requires substantially less time to play than the usual four and one half to six 6 hours. My invention allows completion of play in one and one half hours with four players on each hole playing a full 18 holes together. ALL PUTT course locations need not be in rural areas. Because of the greatly reduced size, site acquisition costs a fraction of what a full-size course would cost. ALL PUTT playing facilities can be near major cities and in plentiful supply. Waiting time is reduced. Time now used traveling to and from rural areas to find available facilities is saved. These advantages clearly make ALL PUTT Championnship Golf a viable commercial entity.

c) to provide an alternative golf game, with substantially all of traditional golf's features: My invention is a par 72, 18-hole game containing four par3s, four par5s, ten par4s, contoured fairways, undulating greens, penalty zones, regulation cups, rough, out of bounds, traditional scoring and a handicap system.

d) An aerial view of an entire 18-hole layout closely resembles a traditional full-size course. There are long, short, straight and dogleg holes each having a different configuration. None of the golf-like games have all of these characteristics. That is definitely an advantage for my invention.

e) to provide rules which establish tournament level quality and retain tradition and character. Modifications must be minimal. Championship levels of challenge can not be compromised. Under the US APGA rules, a player is prevented from reaching any green in less strokes than it takes to do so in full-size golf. This has been accomplished in my invention without diminishing the fun and enjoyment the game provides. The United States ALL PUTT Golf Association (US APGA) has been founded. Official rules have been copyrighted. US APGA design and construction specifications are being updated. These are distinct advantages.

e) to provide incentive for investment by developers. Preliminary market surveys indicate that ALL PUTT Championship Golf has a wide and diverse market waiting for it. It will become evident as the reader continues, how my invention can provide attractive profit potential with a substantially smaller investment and with less risk than a full size golf course project can offer. This adds to its viability and increases investor interest. The initial land acquisition cost for an ALL PUTT course is minimal compared with a full size course. Synthetic grass turf playing surfaces further reduce construction and maintenance expenditures. Operating costs are relatively lower as well. Developers in northern geographic areas can now have the only game in town during winter months. ALL PUTT Championship Golf can be played day and night, all year long, by climatizing courses of up to about 67,000 sq. ft. (3 acres) Air-supported, dome-like fabric structures have translucent skin. They allow sufficient daylight to support vegitation during cold northern winters. This feature opens up a large market in the entire frozen north, a definite advantage.

f) to provide an alternative Golf Game which allows almost everyone the opportunity to play competitively or just for fun. ALL PUTT Championship Golf is a game of skill but not a game requiring physical strength. Because it is an all-putting game it is easy to learn with no professional instruction. All who wish to, including the handicapped, can play. A player with a minimum of practice and average skill can have an exciting experience and a lot of fun the first time they play ALL PUTT. The advantages speak for themselves.

DESCRIPTION OF THE INVENTION

The present invention relates to a novel, alternative method of playing a traditional, championship-calibre golf game both as a serious tournament sport and as a leisure time activity. It is easy to learn without professional instructions and anyone can participate regardless of age, gender, or physical capabilities. ALL PUTT Championship Golf, is played with only a putter and golf ball, on a compact course. Levels of excitement and challenge can be equal to playing championship golf on a full-size course with a full set of golf clubs. Copyrighted US APGA official rules provide detailed playing methods and procedures. Another US APGA function is to provide construction specifications and design outlines for ALL PUTT Championship courses. Starting play at the teeing area of hole No.1, up to four players following modified traditional rules, can play 18 individal and different golf holes in 1½ hours. Each hole is comprised of a teeing area (T), fairway (F) and putting green (G) which may contain multiple cups (C). A golf ball is putted toward the green (G) playing holes 1 through 18 consecutively, and eventually into a cup (C). Long, lag putts over gently contoured fairways characterize this form of championship golf more as a game of depth perception and visual acuity than physical strength. Finesse and deftness of touch used in this all putting game are the same as that used by the touring golf pros. Undulations and greens of tournament level quality make the putting experience substantially the same for players of this golf game. A variety of penalty zones (PZs) are encountered. See FIG. 1 Traditional two-ball, four-ball, and better-ball matches along with stroke play and variations of match play may be enjoyed accordingly.

Figures 1, 2:
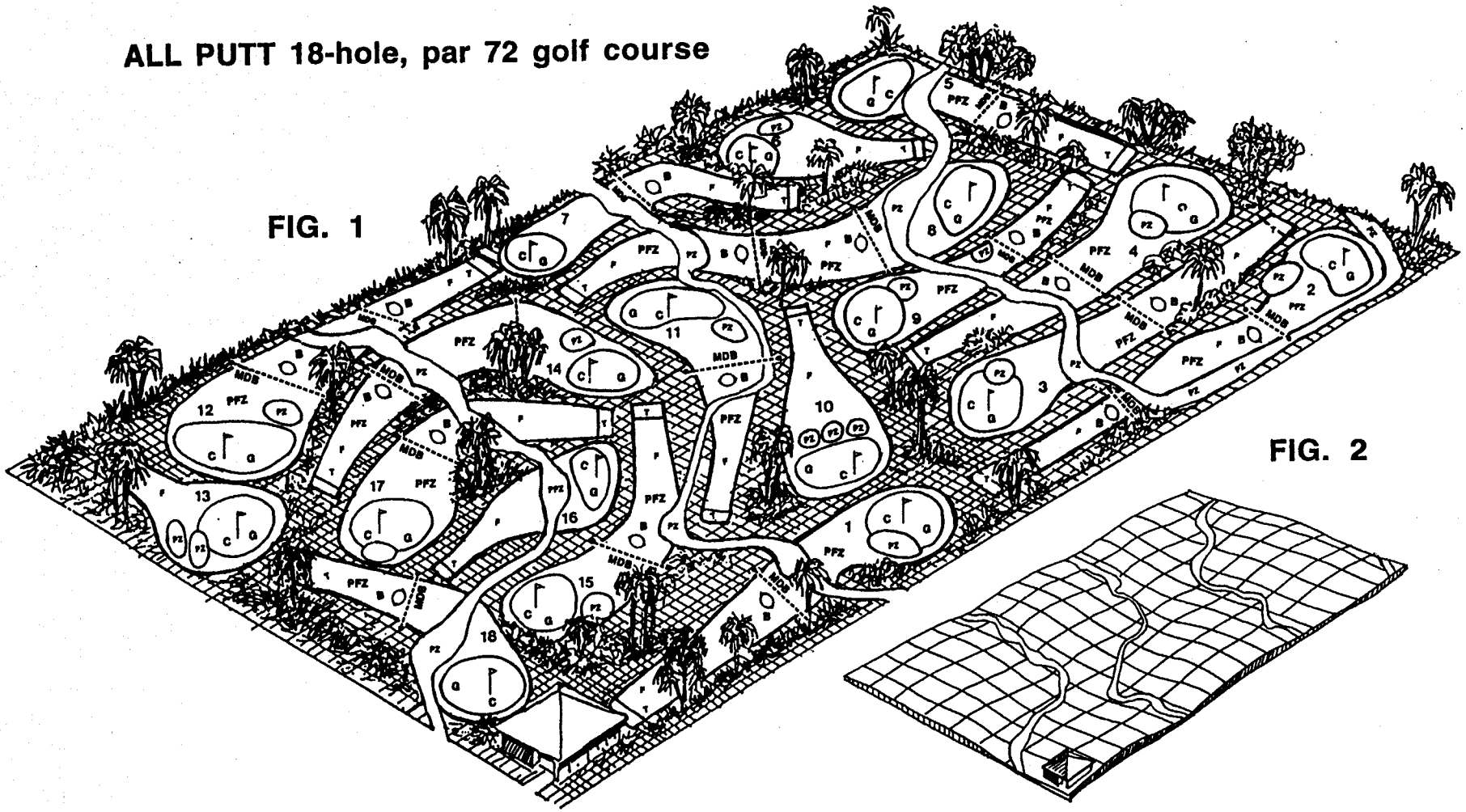
FIG. 1 Overhead perspective view of hypothetical 18-hole par 72 ALL PUTT golf course showing holes numbered 1 through 18, penalty zones, birdseyes, penalty free zones, tees, fairways and greens with three cups each.
FIG. 2 Overhead perspective view showing topographic contours as they relate, specifically to the 18-hole course of FIG. 1.

US APGA official rules require playing the conventional number of par5, par4 and par3 holes on an architect designed course and have a total par rating of not less than 72 strokes. Traditional scoring methods and terminology are used. Sub par scores are identified as birdie, eagle, double eagle and hole in one. Over par scores are bogey, double bogey, triple bogey etc. etc. Playing conditions experienced in full-size golf are simulated by using novel, colored indicia integrated with or affixed to the synthetic grass fairways. This is accomplished by inlaying appropriate shapes and sizes of contrastingly colored synthetic turf into the green fairway areas of the same material. Other methods of defining these penalty zones (PZ) are by dying or painting. A ball coming to rest within PZs are scored the same and represent natural water hazards and sand bunkers. Colors such as blue for water, white or sand color for bunkers in keeping with the emphasis on retaining as much tradition as possible. Rough (R), out of bounds (OB), are identified in FIG. 3 Rough (R) is an area beyond the borders of the fairways (F) which is also synthetic grass but of a slightly higher pile having longer blades. Putting from this area becomes impeded. Although there is no penalty stroke assessed, loss of distance may occur and it may take an additional stroke to reach an intended target because of it. A penalty-free zone (PFZ) is an area in the fairway designated by a golf architect as the place a well played tee shot should come to rest without artificial obstruction or impeding influence. If a ball is lying in a penalty-free zone (PFZ) after the tee shot, the route to the green is unobstructed just as it would be when playing full-size golf. Some prior art define sand-filled sections of fairways inclined toward the player, and meant to impede a golf ball's forward motion, as intermediate landing areas or target areas. In relating to traditional golf, any area in a fairway which obstructs motion of a golf ball and which requires lifting it to play the next stroke is more correctly defined as a hazard of penalty zone (PZ) The golf game described in this document must be played on a course of tournament level quality, hence the emphasis on details and components comprising a US APGA approved design. FIG. 1, An aerial view of an entire 18-hole layout closely resembles a conventional full-size course. There are long and short, straight and dogleg holes, each having a different configuration and a variety of penalty zones. From an elevated view it might, at first, appear to look the same. Lakes, ponds, streams, brooks, bunkers, tees, fairways, greens, rough, etc. are all composed of synthetic grass turf in various sizes, shapes and colors. The game described here is similar to full-size championship golf as it relates to traditional rules, proceedure, scoring, terminology and aspects of its structure.

The written rules of this game are an integral part of the description and follow in their entirety.

US APGA

OFFICIAL RULES

ALL PUTT CHAMPIONSHIP GOLF

Copyright May 1991
United States ALL PUTT Golf Association

CONTENTS / US APGA RULES

| | | Page |
|---|---|---|
| 1. | The Game | 3 |
| 2. | Match Play | 3 |
| 3. | Stroke Play | 3 |
| 4. | Playing Equipment | 4 |
| 5. | Responsibilities of the Player | 4 |
| 6. | Practice | 4 |
| 7. | Advice | 4 |
| 8. | Exchange of Information | 4 |
| 9. | Sequence of Play | 5 |
| 10. | Teeing Area | 5 |
| 11. | Playing the Ball | 5 |
| 12. | Penalty-Free Zones | 6 |
| 13. | Maximum Distance Boundries | 6 |
| 14. | Birdseyes | 7 |
| 15. | Putting Green | 7 |
| 16. | The Cup | 7 |
| 17. | Deflection of a Ball in Motion | 8 |
| 19. | Marking the Ball | 8 |
| 20. | Score Cards/Scoring - Competitive Play | 8 |
| 21. | Penalties | 8 |

1. THE GAME

The game of ALL PUTT Championship Golf consists of playing a ball from the teeing area into the cup on each of 18 holes by stroking it with a putter. Depending upon the skill of the player and the difficulty he encounters, this may be accomplished in a single stroke or several successive strokes in accordance with the rules.

2. MATCH PLAY a. Match play is played hole by hole rather than by strokes unless rules stipulate differently. The team or side which "holes out" in the fewest number of strokes wins a particular hole. Using the handicap system, the lowest net total on a hole determines the winner. Scoring is kept on a "holes up" basis. The terms used, for example, are "one up," "two up," or "all even." If a team is "up" as many holes as remain to be played, it is said to be "dormie."

b. A halved hole occurs when each team holes out in the same number of strokes. A match is considered won at any time when a team is leading by a larger number of holes than remain to be played.

c. A hole may be conceded and the opponent's ball may be removed at any time before it is putted. It is then considered to have been "holed out." A match may be conceded in the same manner. The concession may not be declined or withdrawn.

3. STROKE PLAY a. The player who completes the competition in the lowest total number of cumulative strokes for the round to be played is the winner.

b. The competitor is disqualified if, on any given hole the ball in play is not "holed out" before proceeding to the next hole and teeing off. On the last hole, failure to "hole out" before leaving the green also results in disqualification.

c. During competition under stroke play rules a player may play a second (provisional) ball until all doubts or controversy over the competitor's rights or procedure are clarified by the official committee in authority. A determination can only be made after the player has supplied the facts and before the score card is turned in, otherwise disqualification will occur.

d. Disqualification will result from a competitor's refusal to comply with a rule which affects the rights of another competitor.

e. Breach of rule in stroke play results in a two stroke penalty except in cases which allow for a different assessment.

4. PLAYING EQUIPMENT a. Any putter which is considered regulation or standard design for use on a full-size golf course is acceptable for play in a competition sanctioned by the US APGA. Two piece or other unconventional putters are not allowed. Doubts as to conforming specifications must be clarified by the US APGA Committee.

b. Any regulation golf ball generally approved for play in full-size traditional golf is acceptable for competitive play in ALL PUTT Championship Golf tournaments.

5. RESPONSIBILITIES OF THE PLAYER a. It is the player's obligation to know all conditions and rules which govern participation in the competition being played. These include starting times, handicap strokes, scoring, signing and returning score cards, and specific differences between stroke and match play.

6. PRACTICE a. No practicing on the course, whatsoever, will be allowed before or during play on the day of the competition.

Putting practice on an area of the course specifically designed for that purpose only is permitted. The rule applies to stroke play and match play.

7. ADVICE a. Advice or help in determining the direction or line of a putt may only be given or received by a player's partner.

8. EXCHANGE OF INFORMATION a. All players must be sure information given to opponents, regarding the number of strokes taken on any previous hole, is accurate. This applies to match and stroke play. Failing to do so will invoke penalties unless a mistake is discovered and corrected before the opponent plays the next stroke.

9. SEQUENCE OF PLAY a. The player or team entitled to start first from the teeing area or during play throughout the competition is determined in the following manner:

At the first tee, by order of the draw, otherwise by lot. This is known as "having the honor." The honor from then on goes to the winner of the previous hole. A halved hole retains the honor for the player or team whose honor it was at the previous teeing area.

b. Other than on the teeing area, the player whose ball is farthest from the cup plays first. If two or more balls appear to be the same distance from the cup, the decision as to who plays first is decided by measurement or by lot.

c. In stroke play, order of play from the tee is determined by scores from the last hole: lowest score, next lowest, etc. No penalty is assessed if a ball is inadvertently moved in measuring which one is farthest from the cup.

10. TEEING AREA a. The teeing area is an area defined by markers from within which a ball must be played. In stroke play competition, if all of the ball is lying outside the teeing area when stroked, a penalty is incurred and another ball must be played from within the markers. In match play it is the opponent's option to immediately require the stroke to be replayed without penalty.

11. PLAYING THE BALL a. A ball must be played where it lies except as otherwise stated in the rules. Strokes are counted each time the player strikes the ball and each time the ball comes to rest within a penalty zone. A penalty stroke is also assessed if a ball played from the tee travels beyond the Maximum Distance Boundry on par4 holes and beyond the second MDB on par5 holes as well. Penalty strokes increase the total score. Strokes scored by "birdseyes" reduce the total score.

b. Penalty Zones (PZs) are clearly delineated, colored shapes throughout the golf course which represent sand bunkers, various bodies of water, drainage ditches, marshes, etc. The ball is not to be lifted and dropped outside the PZ. It must be stroked from the place where it rests. No penalty is assessed if a ball crosses over an area designated as a PZ; only if it stops within it. Penalty strokes are also assessed for infractions of the rules.

c. If a ball comes to rest so close to a retaining wall, landscaped area, out-of-bounds rail or other impediment on the course that stroking the ball is not possible, it is deemed unplayable. It may then be moved one club length no nearer the cup with no penalty.

d. A ball must be struck so as to roll it forward toward the putting green. It must not be pushed, shoved or scraped. A ball must not be struck with the intention of causing it to become airborne. Disqualification and removal from the course will result from this endangerment to the safety of others.

e. A ball may not be played when it is moving.

f. A player whose line of play is obstructed by the opponent's ball may ask the opponent to mark his or her ball and lift it. If the situation occurs in a PZ the player may not receive relief and the stroke must be made from the position in which the ball lies without striking the opponent's ball. A penalty is assessed if the opponent's ball is struck and an additional penalty stroke is assessed for each ball in the hazard.

12. PENALTY-FREE ZONES a. A penalty-free zone (PFZ) is the safe area in fairways of ALL PUTT courses adjacent to PZs; water hazards, bunkers, rough, or any area defined as a penalty zone. The PFZ corresponds to the area of a fairway a player attempts to reach safely when playing initial tee shots or approach shots to the green on par4 and par5 holes of a full-size, championship golf course. Putting greens are technically PFZs.

13. MAXIMUM DISTANCE BOUNDRIES a. ALL PUTT courses use maximum distance boundries (MDB), an imaginary line between colored stakes located on opposite sides of the fairway on the out of bounds boundries, to limit the distance a player may stroke the ball from the tee on par4s and on approach shots to the second MDB on par5s. The maximum allowable distance a ball may travel from the tee to the line created by the MDB on ALL PUTT courses is proportional in lineal feet to the average length, measured in yards, a tour professional hits his tee tee shot, depending on size of the ALL PUTT Course.

b. If a ball travels beyond the MDB on any tee shot or beyond the second MDB on a par5, a one stroke penalty is assessed. If a player fails to score a birdseye on the first attempt from the tee on a par-5 hole, a second attempt is allowed but only from behind the first MDB and only if it is the second stroke on that hole. If the player's tee shot is lying in a PZ off the tee, it must first be played back onto the fairway behind the MDB before playing to the green on a par-4 hole which equates to coming out of a fairway bunker or any other PZ. This results in a loss of distance as well as MDB being assessed a penalty stroke for being in a PZ. MDB markers may be moved at the discretion of officials setting up for tournaments. Local rules may give relief from official rules with discretion but not in official tournament competition.

c. If a player disregards the restrictive function of the MDB and attempts to hit a putt with such force as to try to reach a green when the rules disallow it, the penalty is disqualification. In non tournament play, the player will be obliged to leave the course and the area.

14. BIRDSEYES a. A Birdseye's function is to reward skill and inject additional excitement into the game. Preferably eliptical in shape, and located on all par4s and par5s, it provides a player with a score reducing opportunity. Shape, size and location may vary at the architects'disretion. The birdseye is of contrasting color from the color of the fairway.

b. If a ball is putted,in a single stroke from the tee, to a stopped position completely within a birdseye, total score on that hole is reduced by one stroke. On all par-5 holes a player is allowed two attempts to score a birdseye but may not receive more than a one stroke reduction. Playing from behind the first MDB, players who missed a birdseye on their tee shot may try again for a birdseye in a single stroke from where the ball lies. Distance between the first MDB and the second MDB has been established by the use of the same formula as was used o locate the first MDB.

15. PUTTING GREEN a. The putting green is all golf course playing surface other than the teeing area, fairway, rough, out-of-bounds area, and hazards. It is identifiable by color and may contain several cup locations. During each day of competition one cup is "in play" and the others are covered. The putting green surfaces are composed of a close-textured, synthetic grass turf dressed with fine sand. Greens are characteristically contoured and undulating.

16. THE CUP a. The cup is man made and is of the regulation design found on full-size golf courses. It is 4-1/4 inches in diameter and at least 4 inches deep.

b. Any interior liner used must be at least 1 inch below the surface of the putting green. Several locations may be found on a single green. By changing the position of the cup from time to time, the degree of difficulty for a given hole can be increased or decreased. When a ball is at rest in the bottom of the cup it is considered "holed out". All of the ball must lie within the circumference of the cup below the lip of the hole.

c. Circular cup plugs, the tops of which are made of the same material as the putting green surface, cover those holes not being played on a particular day. These covers are installed flush with the surface of the putting greens. The cup in play may change from the previous day providing easier scoring on early rounds and more difficult scoring on the final day of competition. A ball may be accurately putted across covered cups without the path of the ball being altered.

17. DEFLECTION OF A BALL IN MOTION a. If a ball is accidentally struck, stopped or deflected by another player or the other player's ball approaching the green from another location or by the other player's putter, there is no penalty. It is then played as it lies. If both balls were on the putting green prior to the stroke, the player whose ball strikes the resting ball is penalized two strokes. In this case the player whose ball was struck may play the ball as it lies or replace it where it previously rested.

18. MARKING THE BALL a. An opponent's ball must be marked and lifted at the request of a player, whose turn it is to play, if the opponent's ball is blocking free access to the line of the intended stroke from anywhere on the fairway. If the marker is likely to deflect the ball about to be played, the marker may be moved left or right using the putter head to measure the distance the ball is moved. It must be replaced to the original location after the opponent's putt.

19. SCORE CARDS/SCORING - COMPETITIVE PLAY a. Scores in stroke play should be checked with the competitor after each hole by a marker. A marker may be a fellow competitor or someone appointed to record the score.

b. A player is responsible for turning in an accurate score card. The score card must be signed, witnessed and turned in at the completion of the round but not before all controversy is settled with the Tournament Committee and as soon as possible.

20. PENALTIES

| | | |
|---|---|---|
| Rule 3b | - Failure to hole out on any hole in stroke play . . . . . | Disqualification |
| 3c | - Playing second ball, not informing Committee. . . . . | Disqualification |
| 3d | - Noncompliance with rule affecting rights of another competitor. . . . . | Disqualification |
| 3e | - Breach of rule in stroke play. . | 2 strokes |
| 7a | - Breach of rule/match play. . . . | Loss of hole |
| | Breach of rule/stroke play . . . | 2 strokes |
| 8a | - Breach of rule/match play. . . . | Loss of hole |

| | | |
|---|---|---|
| 11a – | Ball resting in hazard . . . . . | 1 stroke |
| 11e – | Ball moving when struck/ match play . . . . . | Loss of hole |
| | Ball moving when struck/ stroke play. . . . . | 2 strokes |
| 11f – | Ball in PZ strikes opponent's ball/match play. . . . | Loss of hole |
| | Ball in PZ strikes opponent's ball/stroke play . . . | 2 strokes |
| 13b | Ball struck from tee to beyond MDB . . . . . | 1 stroke |
| | Ball struck from behind first MDB to beyond second MDB. . | 1 stroke |
| 13c | Intentional disregard for rule . . . . . | disqualification |
| 14b | Ball striking opponent's ball, both on green/match play. . . . . | Loss of hole |
| | ball stroking opponent's ball, both on green/stroke play . . . . | 2 strokes |
| 17b – | Failure to correctly sign score card . . . . . | Disqualification |

The following relates particularly to courses of play and is included because the golf course is inseparable from the game. After a site is found and engineering is complete, together with topographic surveys, the site is cleared, graded and contoured following US APGA fundamental construction proceedures. The understructure is begun with provisions for stormwater disposal and water supply. The understructure is engineered to serve as a base for installation of the golf course surfacing and may be composed of natural elements, concrete or bituminous material. See FIG. 1 Appropriate consideration is given for the addition of natural trees, shrubs and floral planting when building the base for the synthetic turf surfacing material.

US APGA specifications use data gathered from full-size championship golf as reference for designing and building ALL PUTT golf courses. For example, a touring golf pro's average tee shot travels about 265 yds. Distances used when designing an all-putting championship golf course are in direct proportion to 265 yard tee shots and to the overall area of a particular new, ALL PUTT course. When positioning PFZs in the design, contours and undulations are considered challenging elements to a player attempting to stroke a ball into a birdseye. Similar attention is given to locating PZs throughout the course.

It should be noted, that US APGA recommends a minimum size of approximately 1.5 acres for building the smallest ALL PUTT course or, approximately 67,000 square feet. A smaller course would materially change the effective competitive challenge level of the game, and be too closely identified with miniature golf; 20,000 sq.ft. or less than one third the size. Comparison will give the reader a clearer picture of the size and relative lengths of putts required in this game. See FIG. 4. Birdseyes, comparable to bulls eyes, contribute greatly to competitive incentive. They are preferably eliptical, colored areas of synthetic grass turf which the architect may locate anywhere in a penalty-free zone (PFZ) on par4 and par5 fairways. They may be any size the architect feels is effective in keeping with championship levels of play which characterizes this game. Rules of scoring provide a one-stroke reduction if a ball is played from the tee into a birdseye with a single putt from the tee. Only one stroke reduction is allowed, though there are two chances to score birdseyes on the four par5s. Details about birdseyes, their physical structure, locations and scoring is found in the US APGA rules section of this document.

Penalty zones (PZs) are colored shapes, positioned in fairways in strategic locations to penalize players for their inability to control their shots. One penalty stroke is added to the score as a result of a misdirected ball stopping in a PZ. Conventional names for penalty zones are water hazards and sand bunkers. PZs are either dyed, painted or inlaid into the synthetic fairway surface. Contrasting colors distinguish them from the fairway. A golf ball can be easily putted across a penalty zone because the fairway is constructed of the same material. No penalty is assessed unless the ball stops within a PZ. Putting on fairways and greens compares to that experienced on greens of growing grass turf. More data about components and construction processes for building ALL PUTT Championship Golf courses is found in the US APGA specifications. Tournament-level, full-size championship golf is a game played on golf courses which meet certain strict criteria. Official rules and course specifications are written and administered by golf associations such as the PGA and USGA. These governing bodies rate golf courses according to their quality of design and level of difficulty and condition. The game played on a tournament ready, full size course is entirely different than casual golf played by average golfers on weekends. Overall length, number and severity of hazards, trueness and speed of the putting greens, character and competitive level of challenge are assessed carefully before championship status is awarded. ALL PUTT Championship Golf described here, is as different from miniature golf and pitch and putt golf as championship, full-size golf is from weekend golf. Attention has been given to explaining design elements of US APGA approved golf courses so that the novel structure of the game is better understood. The golf course is an inseparable part of the overall concept. This invention is meant to provide a superior quality golf game which closely simulates full-size, championship golf. No other successful attempt to offer a viable, credible alternative to traditional, full-size championship golf can found after searching prior art files in the PTO.

Each ALL PUTT course is individually designed by a golf course architect. Consideration is given to the topography, the size of the land area and what degree of difficulty a developer wishes to build into it. The total area of a particular course may range from about 1.5 acres, or 67,000 sq.ft. to about 6.0 acres or about 252,000 sq.ft. For comparison, the average miniature golf course is about 20,000 sq.ft. Full size championship calibre golf courses require about 170–180 acres. To provide tournament level credibility in playing ALL PUTT courses levels of challenge and skill are not compromised. In full-size, golf no par4 hole can be reached in a single drive from a teeing area. Accordingly, under strict rules imposed by US APGA a player is prevented from reaching any green in less strokes than are needed in the full-size game, on a full-size course.

DESCRIPTION/OPERATION

A preferred embodiment of the present invention is illustrated in FIG. 1, an overhead perspective view of an 18 hole ALL PUTT golf course and in FIG. 2, a direct overlay sketch of the perspective view in FIG. 1 showing topographic contours as they might relate to that specific course design. It shows how contours and grading can transform an otherwise flat, uninteresting course into one of championship calibre.

ALL PUTT Championship Golf is a game just as challenging as the full size game without thirteen of fourteen golf clubs normally used. Because of its substantially smaller size it is played with only a putter and a single golf ball. It can still promote as much competitive spirit and excitement.

Without comprehensive rules and features like maximum distance boundriss (MDB), birdseyes (B), penalty zones (PZ) however, it might be just another amusement park game. For example, it is not possible, if played by the US APGAs strict rules, to reach any green in less strokes than it takes in playing the game on a full size 7000 yard championship course. Penalty strokes result and even disqualification, if the rules are broken. Using a formula based on the average length of touring professionals' tee shots, the US APGA rules establish the maximum distance tee shots on all par4 and par5 holes may travel in ALL PUTT golf. The fairway shot from the MDB to the next MDB on par5 holes may not go beyond it without a penalty. See FIG. 5*a*, 5*b* and 5*c*. The long 265 yard drive with a carry over water to a safe landing on a narrow, distant fairway has been eliminated.

Figure 3:
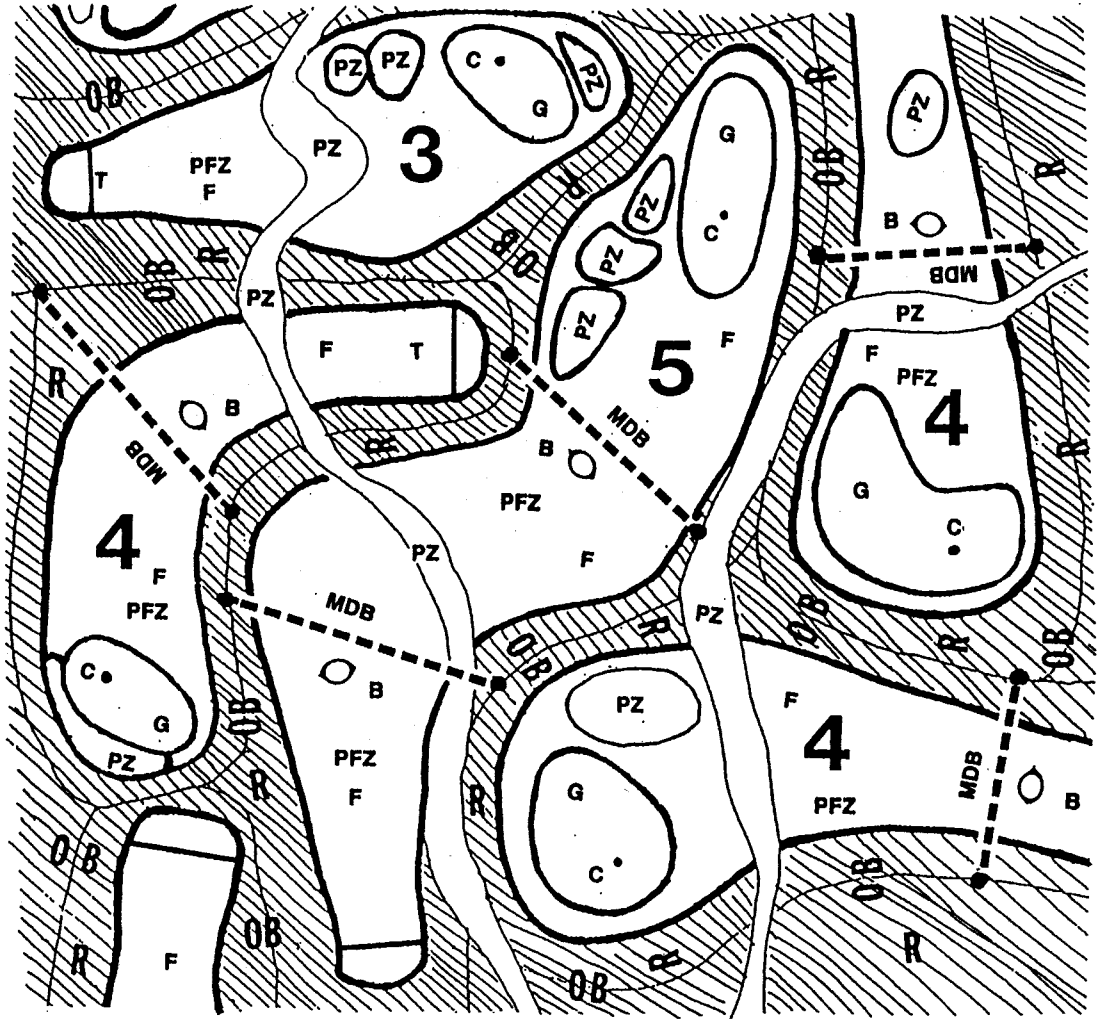
FIG. 3 Overhead view of enlarged component section of a hypothetical ALL PUTT golf course. Large numerals 3, 4 and 5 refer to par. Alphabetical references identify important elements of a typical ALL PUTT course. T . . . Teeing area/F . . . Fairway/G . . . Green/R . . . Rough/OB . . . Out of bounds/C . . . Cup PFZ . . . Penalty free zone/pZ . . . Penalty zone/B . . . Birdseye MDB . . . Maximum distance boundary. Numerals 1–18 golf course playing sequence. Large numerals specify par3, par4 and par5.

Although it can not replace this almost sacred element of golf, the birdseye (B) FIG. 1 and FIG. 3—adds a new challenge to the players' skill and potential for an equally thrilling experience. FIG. 3 illustrates the relationship between the MDB and birdseye. The golf architect has the latitude to employ these two new elements with discretion and in so doing, create as much gamble for the player as he sees fit to do.

The MDB is an imaginary line extending across the fairway in two places on each par5 hole and once on all par4 holes. It extends from a colored stake or marker at the out of bounds (OB) line on each side of the fairway. Some what like the game of shuffleboard played in pubs and bars, the MDB rewards the well placed shot like the shuuffleboard weight which stays on the table, close to the far edge. Visual acuity is a valuable skill for playing that game well too. In ALL PUTT Championship Golf a player is faced with a comparable challenge. Birdseyes (B) are, at the architects discretion, positioned somewhere in the area extending forward of the teeing area (T) in the penalty free zone (PFZ) preferably as near as possible to the MDB on the players side of the boundry. An area shaped like an eye,in a contrasting color to the fairway, the birdseye is positioned so that the MDB comes into play. The contouring plays a part as well. A player may elect to go for it or play it safe. A one stroke reduction from the score on that hole if the ball is successfully stroked to a resting place within the birdseye (B) in a single stroke from the teeing area (T) or a one stroke penalty added to the score if the ball crosses the MDB. By moving these birdseyes an architect may increase or decrease the gamble a player must take to score a birdseye (B). The MDB may also be moved to effect the same results.

SUMMARY, RAMIFICATIONS AND SCOPE

Accordingly the reader will see that the needs of millions of potential golfers as outlined above, are met in this invention. ALL PUTT Championship Golf is a unique game played with only a regulation putter and golf ball. Significant reductions in size of US APGA courses provide substantially less expensive, easier to learn, and faster means of playing tournament level golf. In some ways the game is more interesting and without losing many traditional values. Par5s and par4s are effectively combined with the usual par3s for the first time in a tournament level golf game played on a golf courses reduced to 1 to 4% of the size of the average full size championship golf course.

Although the description above contains many specifities, these should not be construed as limiting the scope of the invention but as merely providing illustrations of the presently preferred embodiments of this invention. Thus the scope of the invention should be determined by the appended claims and their legal equivalents, rather than by the examples given.

CLAIMS/ALL PUTT CHAMPIONSHIP GOLF

What is claimed is:

1. A method of playing traditional, championship golf using only a putter and a single golf ball, comprising the steps of:

a) providing a reduced size golf course including a series of eighteen holes each including a playing surface simulating grass and defining a teeing area and a putting green at opposite ends of a fairway, means for limiting the number of strokes to play said eighteen holes, using only a putter and a single golf ball, to a par 72, the said eighteen holes including four par-3 holes, four par-5 holes and ten par-4 holes.

b) providing representations of natural hazards along said holes as bunkers and water hazards by selectively colored areas wherein a selected color is employed to represent a particular hazard and any penalty associated therewith, and, c) providing and indicating maximum distance boundries across the fairways of said holes in selective manner past which the player must not stroke a ball with the putter without incurring a penalty, and, d) said colored areas and boundries being so arranged that the player may play the reduced area course with only a putter as if it were a full size championship golf course by virtue of the selective stroke distance boundaries and hazard indications and the player is prevented from reaching each of said greens in less strokes than it take to reach the greens in said full size course using select clubs from a set of clubs.

2. The method of claim 1 wherein in providing a maximum distance boundry, the indicated maximum distance boundry is proportional on the reduced size course to the length of an average tee shot of a professional golfer playing a full size championship golf course on a hole requiring maximum distance.

3. The method of claim 1 includng providing a score-reducing indicia called a birdseye, into which the player must putt the ball in a single stroke from the teeing area to a stopped position in order to achieve a one stroke score reduction on said hole, said ball must be totally inside the perimeter edge of said birdseye indicia and a second maximum distance boundary and, in providing a second indicia on par-5 holes only to that, the player is allowed, another attempt to achieve a score reducing birdseye, if the first attempt was not successful, and if said player is putting from behind the second maximum distance boundary and has not played more than one stroke on that hole.

Figure 4:
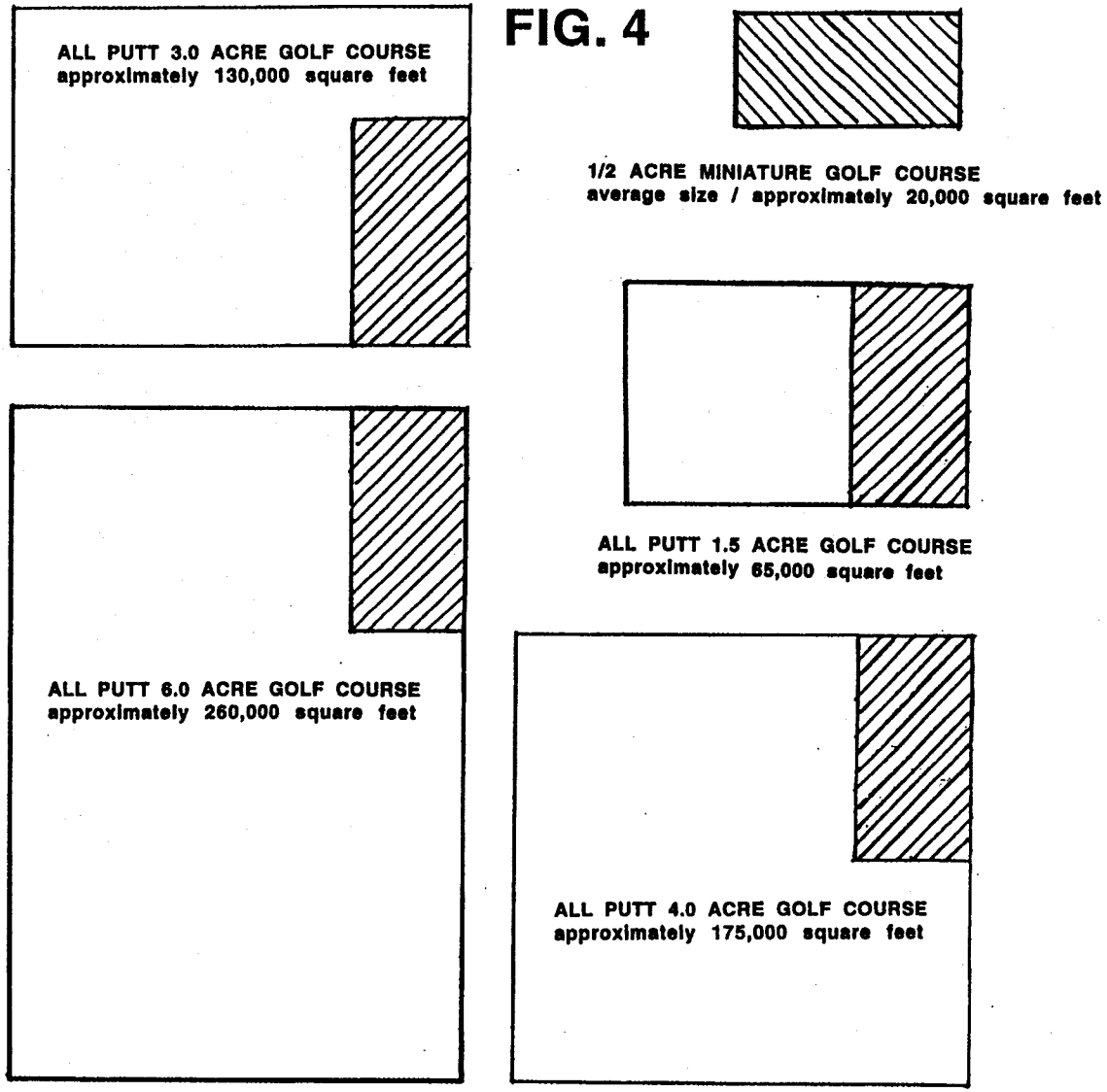
FIG. 4 Graphs showing ALL PUTT course sites of 1.5, 3.0 and 6.0 acres and relative size of each to an average size miniature golf course having 18 holes.

FIG. 4 Graphs showing ALL PUTT course sites of 1.5, 3.0, and 6.0 acres and relative size of each to an average size miniature golf course having 18 holes.

Figure 5A:
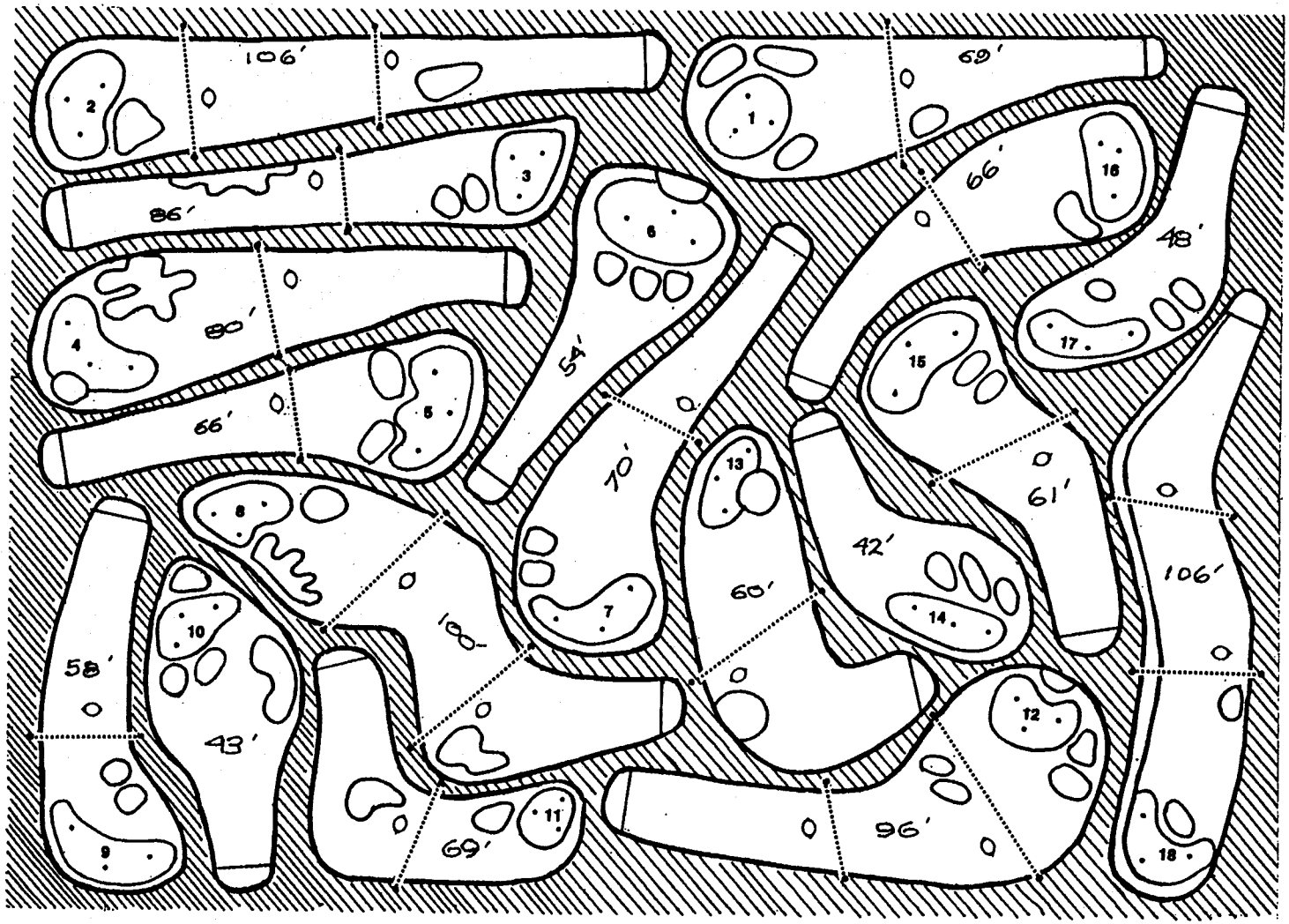
FIG. 5*a and FIG. 5b* and FIG. 5*c* / direct overhead view of a hypothetical ALL PUTT course design and versions of expanded sizes from 1.5 acres to 6 acreas.
Figure 5B:
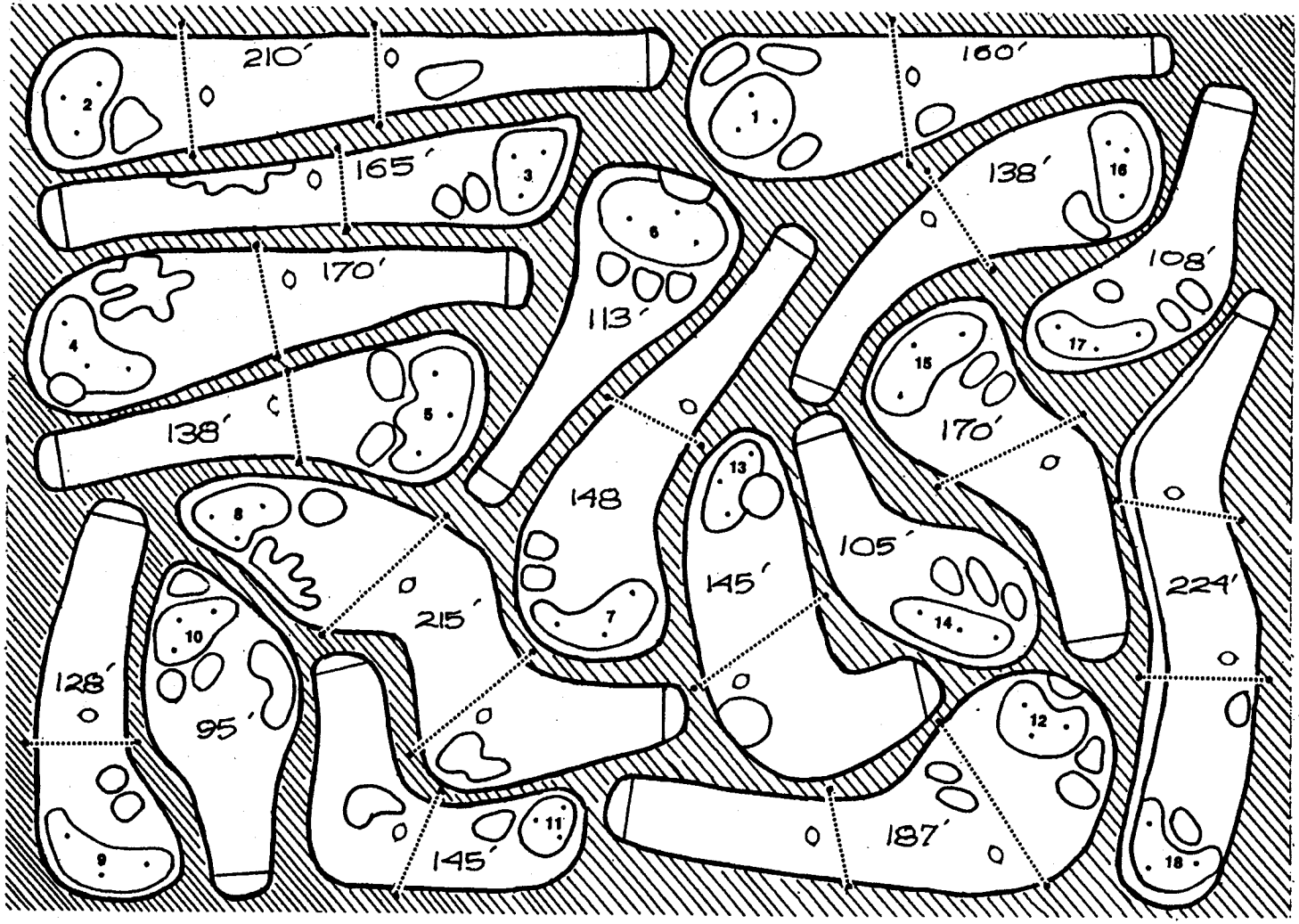
Figure 5C:
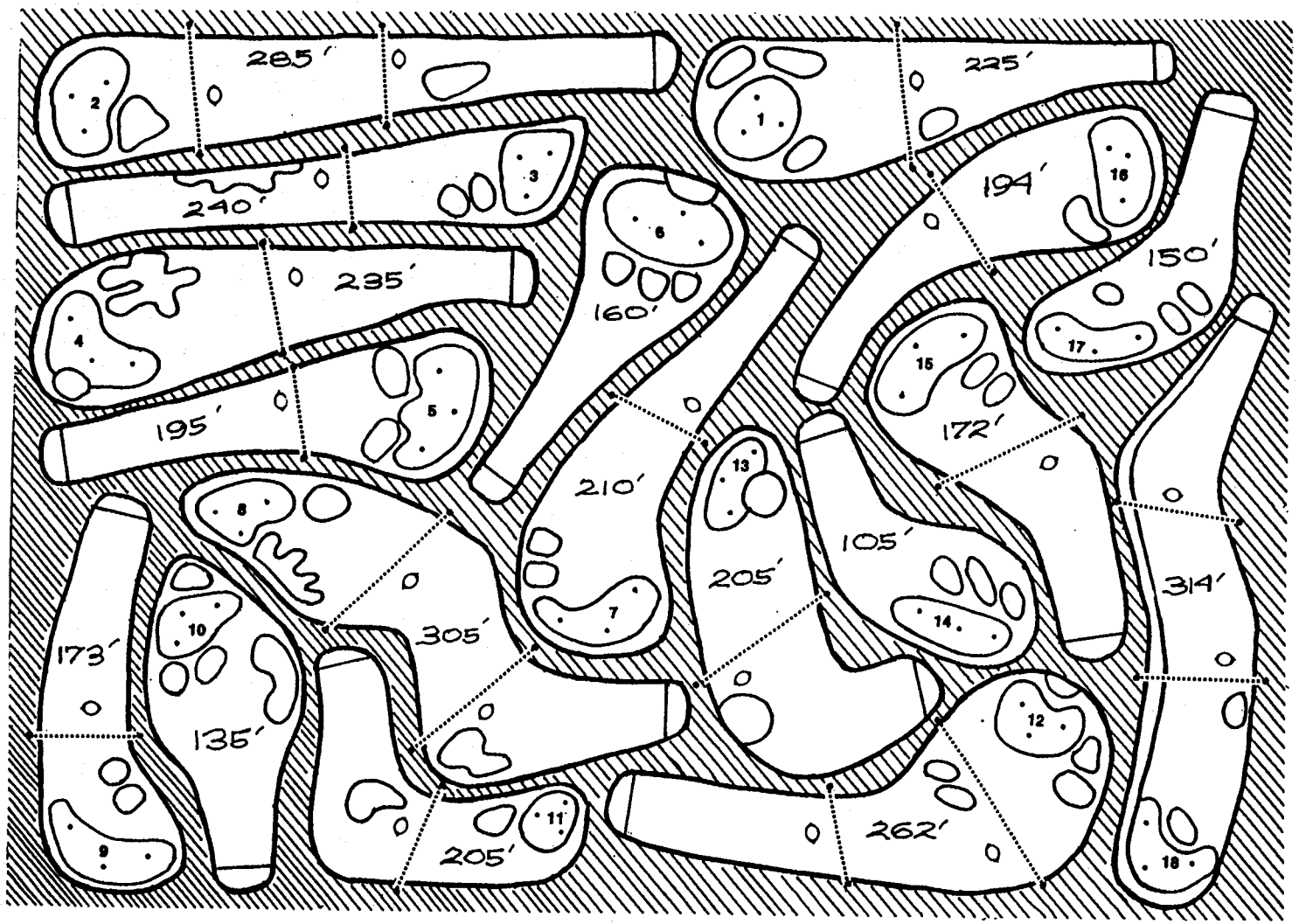

FIG. 5*a*, FIG. 5*b* and FIG. 5*c*/direct overhead views of a hypothetical ALL PUTT course design and versions of expanded sizes from 1.5 acres to 6 acres.

Figure 6A:
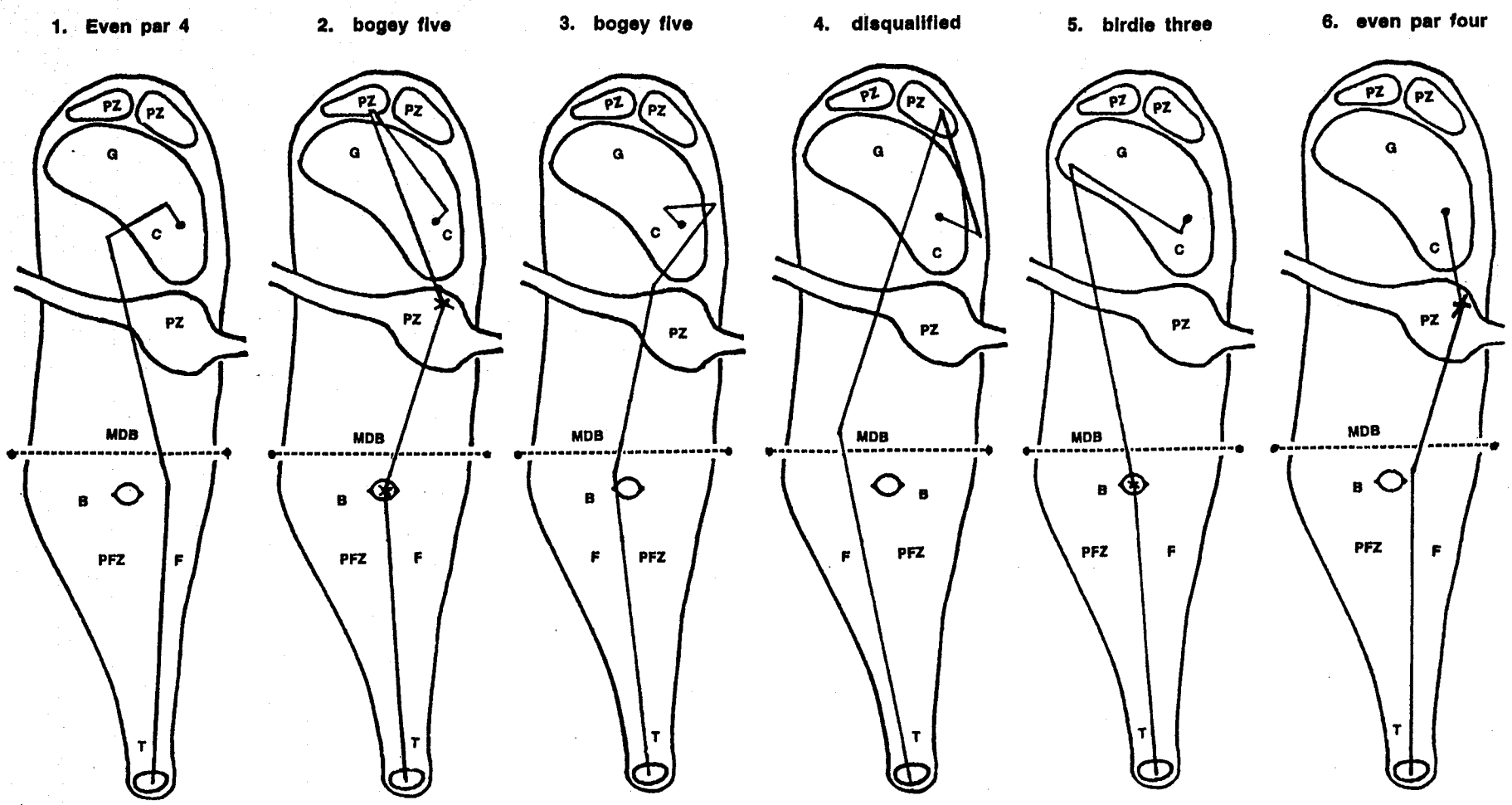
FIG. 6*a* and FIG. 6*b* showing six variations of scoring situations on each of a typical par 4ALL PUTT golf course.
Figure 6B:
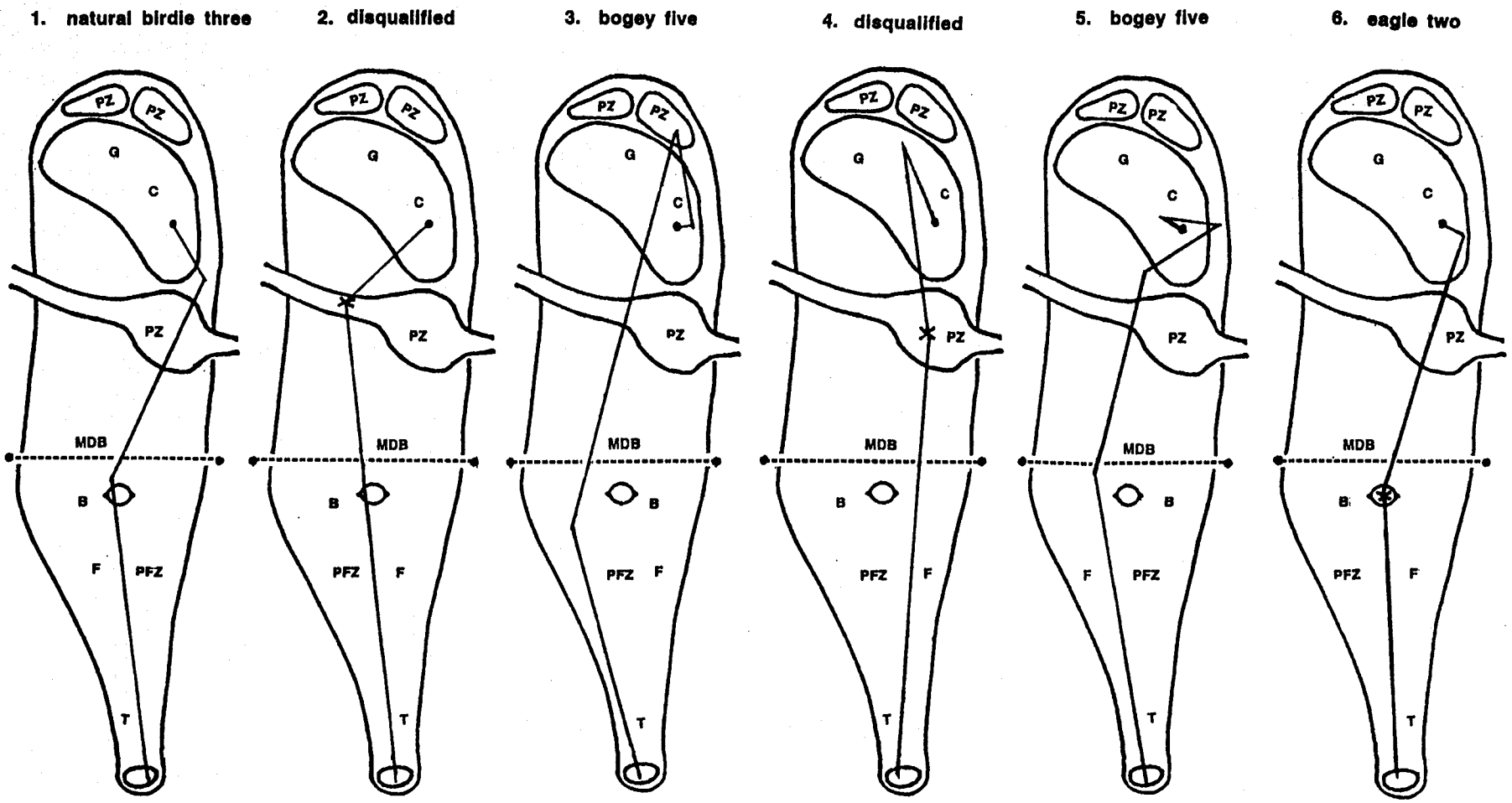

FIG. 6*a* and FIG. 6*b* showing six variations of scoring situations on each of a typical par 4 ALL PUTT golf course.

Figure 7:
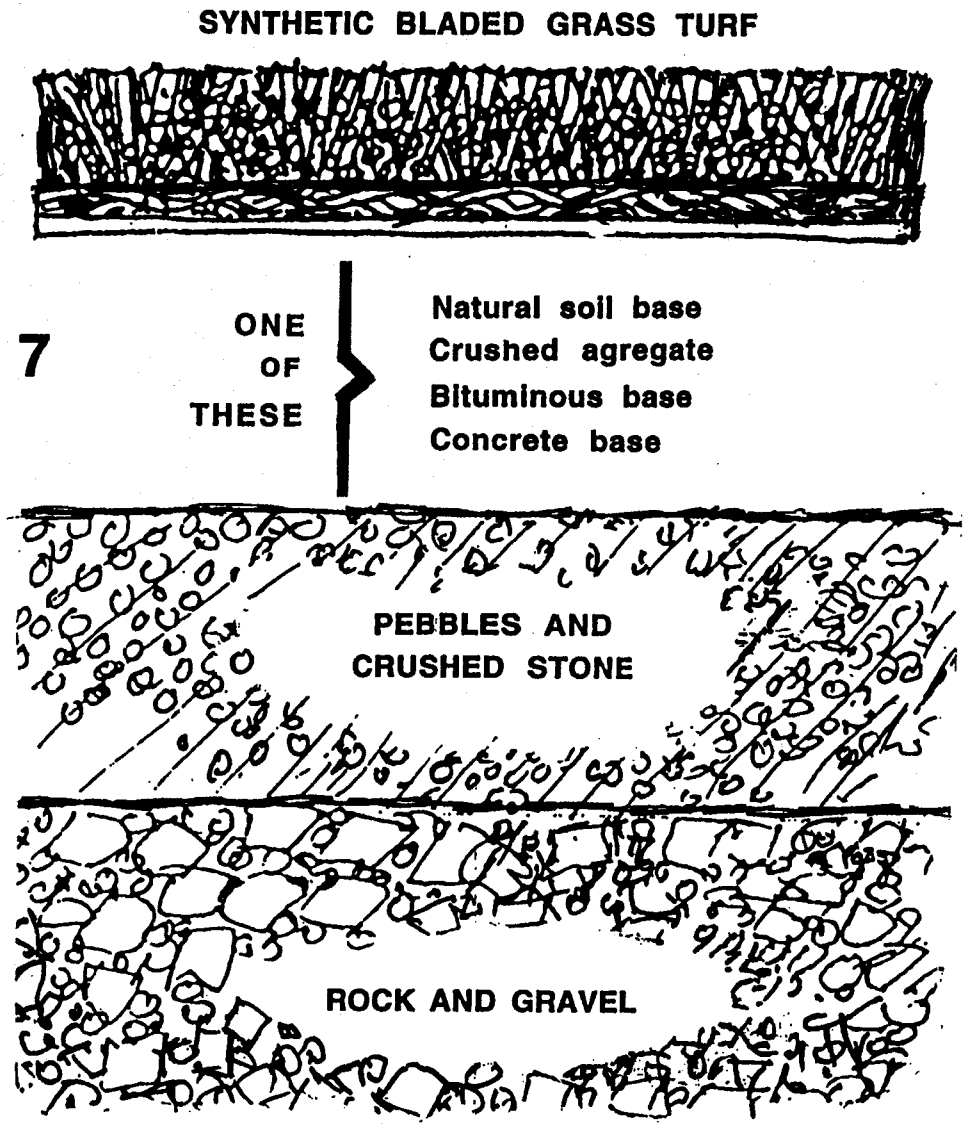
FIG. 7 Diagrammatic cutaway sketch showing an example of how synthetic, grass turf of a fairway/green area of an ALL PUTT course might be installed over a substructure of natural soil, or any one of the other materials mentioned, such as concrete, bituminous or crushed aggregate.

FIG. 7 Diagrammatic cutaway sketch showing an example of how synthetic, grass turf of a fairway/-green area of an ALL PUTT course might be installed over a substructure of natural soil, or any one of the other materials mentioned, such as concrete, bituminous or crushed aggregate.

* * * * *